US009215898B2

(12) United States Patent
Clement et al.

(10) Patent No.: US 9,215,898 B2
(45) Date of Patent: Dec. 22, 2015

(54) SHIN GUARD

(71) Applicant: HAYABUSA FIGHTWEAR INC., Kingston (CA)

(72) Inventors: Ken Clement, Milton (CA); Craig Clement, Kingston (CA); John David Zikakis, Mount Albert (CA)

(73) Assignee: HAYABUSA FIGHTWEAR, INC., Kingston, Ontario (CA)

( * ) Notice: Subject to any disclaimer, the term of this patent is extended or adjusted under 35 U.S.C. 154(b) by 188 days.

(21) Appl. No.: 13/801,238

(22) Filed: Mar. 13, 2013

(65) Prior Publication Data

US 2013/0283491 A1 Oct. 31, 2013

Related U.S. Application Data

(60) Provisional application No. 61/638,671, filed on Apr. 26, 2012.

(51) Int. Cl.

| | |
|---|---|
| ***A41D 13/05*** | (2006.01) |
| ***A63B 71/12*** | (2006.01) |
| ***A63B 69/00*** | (2006.01) |

(52) U.S. Cl.

CPC ..... *A41D 13/0543* (2013.01); *A63B 69/004* (2013.01); *A63B 71/1225* (2013.01); *A63B 2071/1258* (2013.01); *A63B 2209/00* (2013.01); *A63B 2209/10* (2013.01)

(58) Field of Classification Search

CPC ... A41D 13/0543; A41D 13/06; A41D 17/02; A63B 71/1225

USPC ..... 2/22; 128/878, 882; 602/23, 26, 62

See application file for complete search history.

(56) References Cited

U.S. PATENT DOCUMENTS

| | | | | |
|---|---|---|---|---|
| 3,934,583 | A * | 1/1976 | Hollingshead et al. | 602/62 |
| 5,507,720 | A * | 4/1996 | Lampropoulos | 602/27 |
| 7,069,670 | B1 * | 7/2006 | Gerke | 36/2 R |
| 2003/0167548 | A1 * | 9/2003 | LaShoto et al. | 2/22 |
| 2005/0108800 | A1 * | 5/2005 | White | 2/2.5 |
| 2010/0319098 | A1 * | 12/2010 | Watt | 2/22 |
| 2011/0167529 | A1 * | 7/2011 | Anderson et al. | 2/2.5 |
| 2014/0215678 | A1 * | 8/2014 | Greenbaum | 2/22 |

* cited by examiner

*Primary Examiner* — Katherine Moran

(74) *Attorney, Agent, or Firm* — Moore & Van Allen PLLC

(57) ABSTRACT

A shin guard for combat sports is provided having increased protect for the wearer and the opponent. The shin guard has sleeve for surrounding the lower leg of the wearer and a front padding attached to the sleeve with a top portion reversibly secured which covers and hides a closure system. The shin guard may also have a calf reinforcement.

10 Claims, 6 Drawing Sheets

SHIN GUARD

FIELD OF THE INVENTION

The present invention relates generally to leg protection. More specifically, the invention relates to a shin guard, particularly for use by wearer involved in combat sports.

BACKGROUND

Shin guards are worn in a variety of sports to protect the lower legs of the wearer during competition and training. It is important that shin guards offer proper protection, while still being comfortable and lightweight without restricting the mobility of the wearer. The most commonly known type of shin guard consists of a resilient material, such as foam, strapped to the lower legs. This basic shin guard is lightweight and does not unduly restrict the mobility of the wearer. However, most commonly known shin guards are not concerned with protecting the opponent.

While the primary purpose of shin guards is to protect the wearer from accidental blows or impacts during sports, such as soccer or hockey, and in combat sports such as kickboxing, mixed martial arts, jiu-jitsu, and wrestling, it is also important to consider the comfort and safety of the opponent and to reduce the likelihood of the shin guard catching on clothing or causing abrasions to both the wearer and the opponent. In such combat sports blows or impacts are more common due to the nature of the activity, particularly since kicking the opponents legs may be allowed, or intentional, and the shin may be used for striking and blocking. Furthermore, in such combat sports it is also desirable to provide protection to the instep of the wearer as the instep may be used for striking.

There are various means known for securing shin guards to the wearer. For the soccer-type shin guard, the shin guard may be placed beneath a sock or within a pocket in a sock. For other shin guards resilient straps may be used that are either separate or incorporated as encircling the shin guard. However, these rigid shin guards are not well-suited for combat sports. There is a need for shin guards that are suited for combat sports and overcome the problems of the shin guards designed for other sports.

SUMMARY OF THE INVENTION

Accordingly, there is a need for a shin guard for use in combat sports that, while providing the requisite protection and mobility to the wearer, also provides for reduced irritation to both the wearer and the opponent(s).

In particular, the shin guard has a front padding attached to a sleeve along most of its length, except for a top portion of the front padding adjacent the wearer's knee that is reversibly attachable. A closure system at the top of the sleeve, which secures the shin guard to the leg of the wearer, is hidden beneath the top portion of the front padding. When the front padding is secured, the closure system is hidden and is unlikely to catch on clothing or cause irritation.

In an embodiment of the present invention, there is provided a shin guard comprised of a sleeve and having a top portion, a bottom portion, a front portion, and a back portion, the front and back portions each having atop portion and a bottom portion. There is front padding attached to the front of the sleeve along its length from the instep up toward the top, except for a top portion of the front padding adjacent to the knee. The unattached portion of padding is reversibly secured to the sleeve and covers a closure system at the top of the sleeve. The shin guard also has a foot loop for maintaining the position of the shin guard.

In another aspect, the sleeve is an elastic material or a neoprene material.

In a further aspect, the shin guard also has a calf reinforcement affixed to the back portion of the sleeve. As a further option, the calf reinforcement is cross-shaped. The calf reinforcement may be made of a material less elastic than the sleeve material.

BRIEF DESCRIPTION OF THE DRAWINGS

Embodiments will now be described, by way of example only, with reference to the attached Figures, wherein.

DETAILED DESCRIPTION

The present invention provides a shin guard having a hidden closure system that reduces the likelihood of the closure catching on clothing and causing irritation. The preferred embodiment will now be described with reference to the figures wherein like elements are identified by like numbers.

Figure 1:
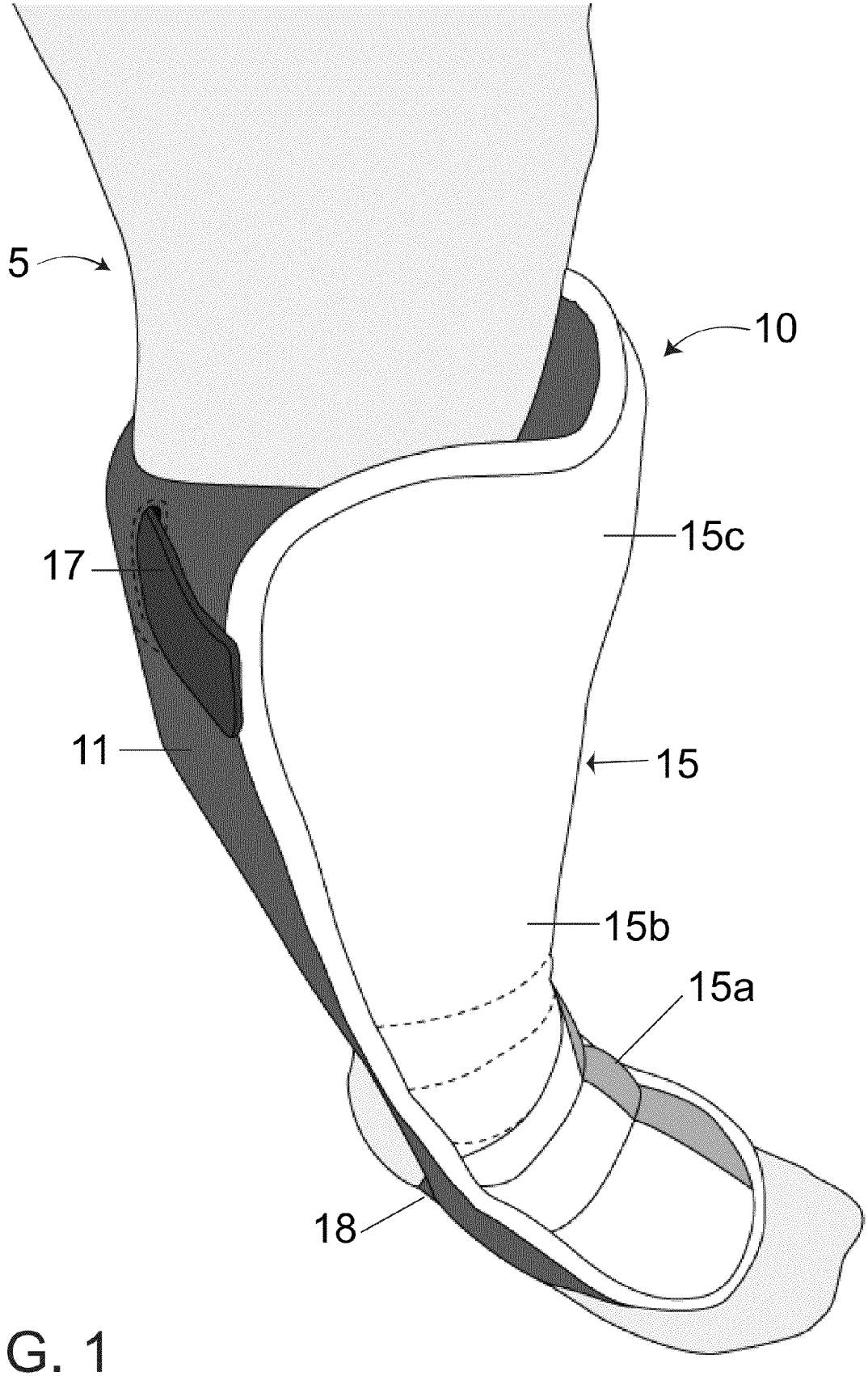
FIG. 1 is a front elevation perspective view of a shin guard showing the closure system open and unsecured and the top region of the front padding secured in accordance with an embodiment of the present invention.

A shin guard in accordance with the present invention will now be described in detail with reference to the figures. The shin guard 10 is shown in FIG. 1 on the leg 5 of the wearer in an unsecured configuration. The sleeve 11 has a top portion near the knee of the wearer, a bottom portion near the ankle of the wearer. The sleeve 11 also has a front sleeve portion (not clearly shown of FIG. 1 because of the front padding 15) extending along the length of the sleeve from the top sleeve portion to the bottom sleeve portion. The front sleeve portion includes: a front top portion being near the knee of the wearer; a front bottom portion (not clearly shown of FIG. 1) being near the instep of the foot of the wearer and extending along the length of the sleeve; a back top portion near the knee of the wearer; a back bottom portion near the heel of the foot of the wearer; and two opposing sides of the front sleeve portion extending along the length of the sleeve and joining the front portion of the sleeve with the back portion of the sleeve. Thus, the sleeve 11 is a tubular form, similar to a sock. In a preferred aspect, the sleeve 11 is form fitting and elastic. Any suitable material or fabric may be used to construct the sleeve 11; however, a neoprene material is particularly preferred. In some aspects, the sleeve 11 is fabricated as a composite of different materials but is preferably made from a single material.

On the front of the sleeve 11 is front padding 15. The front padding 15 has an instep region 15*a* covering at least a portion of the instep of the wearer and a shin region 15*b* covering a portion of the shin of the wearer from at or near the ankle and toward the mid-area or the top of the shin. The instep region 15*a* and the shin region 15*b* are attached, or affixed to the front of sleeve 11 and are also flexibly connected to one another to allow the wearer of shin guard 10 to flex and extend their foot. The front padding 15 also has top region 15*c* covering a top portion of the shin and unlike the instep region 15*a* and the instep region 15*b*, may be selectively and adjustably attached to the sleeve 11 by a fastening system.

It should be mentioned that the front padding may be partially or fully removable from the sleeve. In other words, the top region 15*c* may be pulled away from the sleeve 11.

The fastening system may be any suitable system for selectively and reversibly attaching the top region 15*c* of the front padding 15. The preferred fastening system is hook-and-loop, such as a Velcro® system, with complementary hook-and-loop surfaces on the inside of the top region 15*c* of the front padding 15 and the front top portion of sleeve 11. The front padding 15 may be constructed of any suitable materials or fabrics. In some aspects, the front padding 15 is constructed of an outer covering layer which, for example, may be made of a leather or polyurethane material, or of a combination of synthetic and real leather materials that enclose an impact absorbing material.

The shin guard 10 has a closure system 17 (that is shown in an unsecured state in FIG. 1) at the top of sleeve 11 for selectively and adjustably tightening and securing the shin guard 10 on the leg of the wearer. The closure system may be any suitable system for selectively and adjustably tightening and securing the shin guard 10 on the leg of the wearer. A preferred closure system is a strap configured to tighten the sleeve when the strap is pulled and having hook-and-loop surfaces complementary to the hook-and-loop surfaces affixed to the front padding 15*c* and the front top portion of the sleeve 11 and the top region 15*c* of the front padding 15. In such a configuration, when the closure system 17 is engaged to tighten and secure the shin guard 10 on the leg of the wearer, and when the front padding 15*c* is secured to the sleeve 11, the closure system 17 is fully enclosed between the front padding 15*c* and the sleeve 11, thereby preventing the closure system from catching on clothing, from causing skin irritation or damage, or from becoming unsecured during use (not shown in FIG. 1).

The shin guard 10 also has at least one foot loop 18 (not fully shown in FIG. 1) attached to, or extending from, the bottom of the sleeve 11. The foot loop 18 partially wraps around the foot of the wearer to help maintain the position of shin guard 10 during use, primarily to prevent the shin guard 10 from rising up. The foot loop 18 is preferably positioned to wrap around the arch of the foot of the wearer. The foot loop 18 may be made of any suitable material or may be made of the same material as the sleeve 11.

Figure 2:
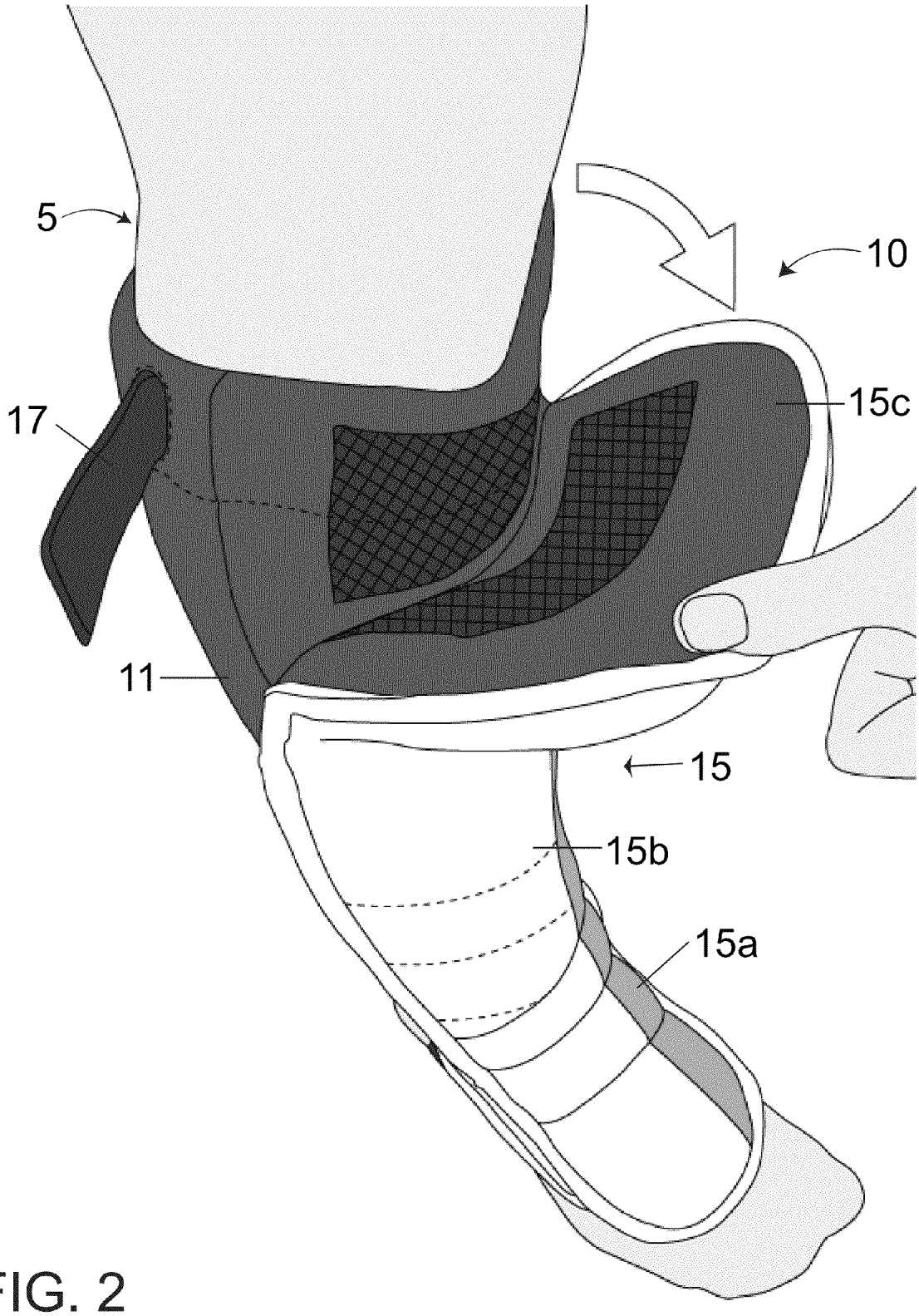
FIG. 2 shows the shin guard shown in FIG. 1 with the closure system and top region of the front padding both open.
Figure 3:
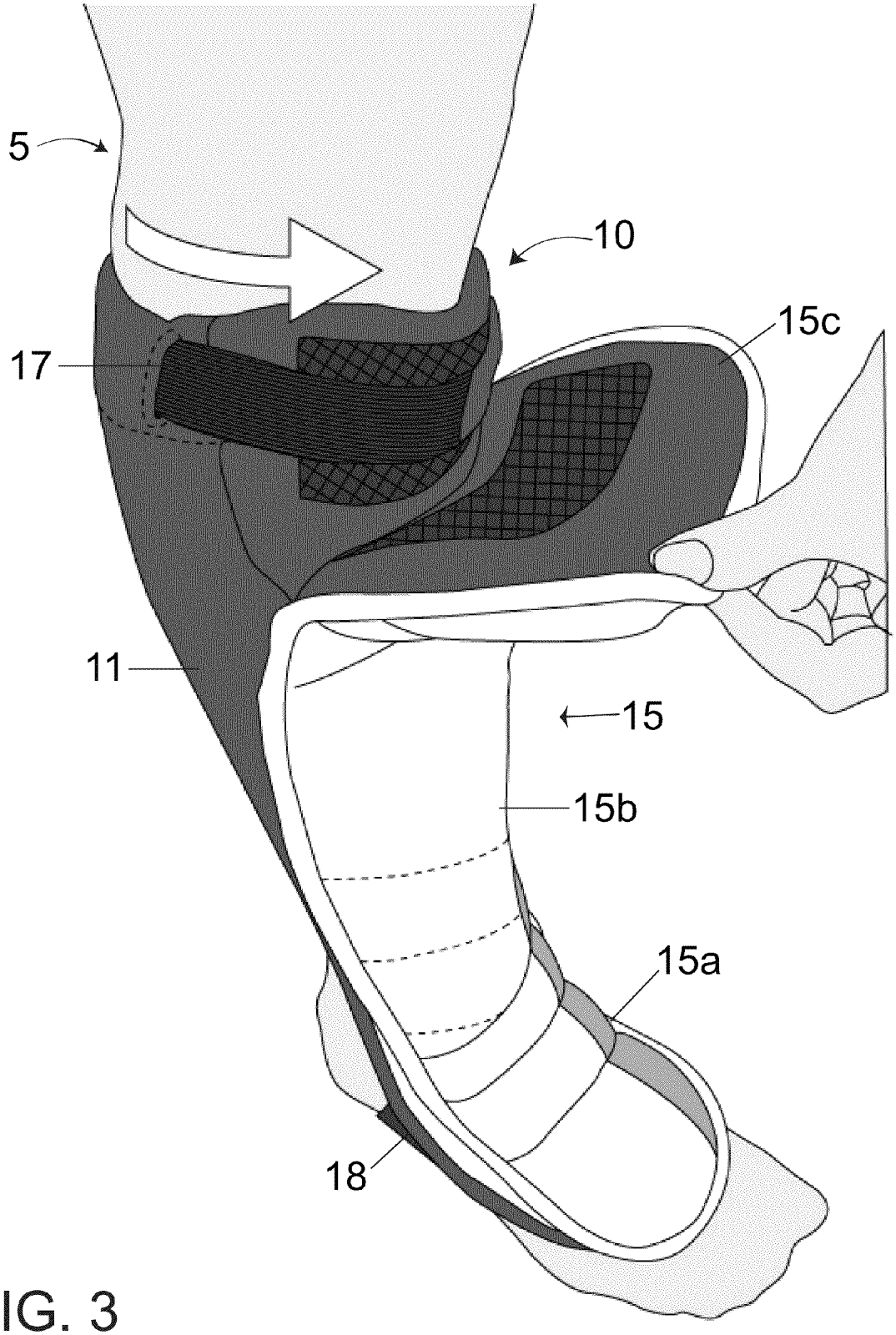
FIG. 3 shows the shin guard shown in FIGS. 1 and 2 with the closure system tightened and secured with the top region of the front padding open.
Figure 4:
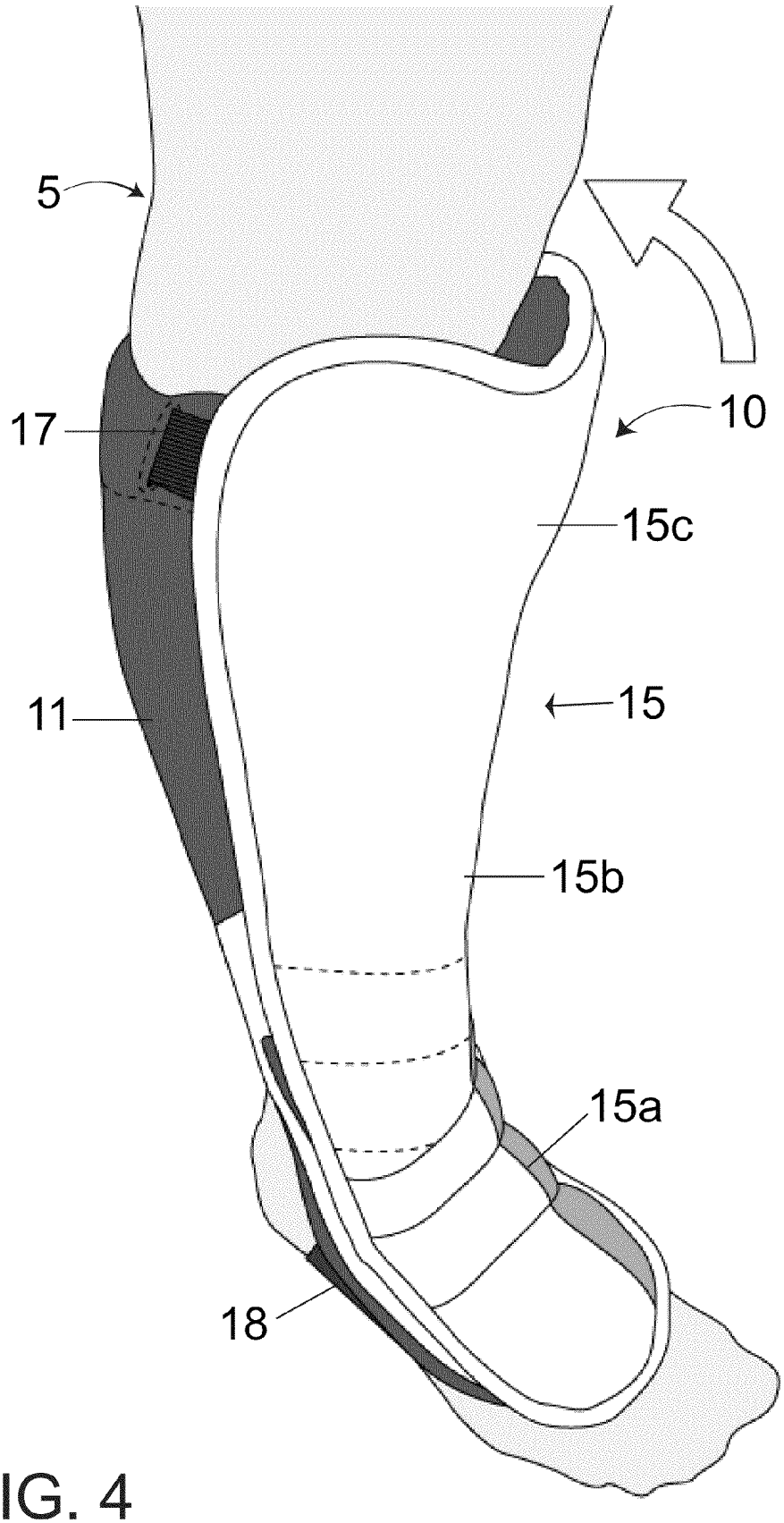
FIG. 4 shows the shin guard shown in FIGS. 1, 2, and 3 with the closure system tightened, secured, and hidden behind the secured front padding.

FIGS. 2, 3, and 4 show the stepwise process of securing the closure system 17 and securing the top region 15*c* of the front padding 15 over top of securing the closure system 17, thereby enclosing the closure system 17. The complementary hook-and-loop surfaces on the inside of the top region 15*c* of the front padding 15 and the front top portion of the sleeve 11 are shown as the cross-hatched areas (in FIGS. 2 and 3).

FIG. 2 shows the closure system 17 in an open and unsecured state with the top region 15*c* of the front padding 15 also open and unsecured. The first large arrow descending from the knee area of the wearer indicates the direction of pulling the wearer may exert on top region 15*c* before tightening the closure system 17.

FIG. 3 shows a closure system 17 tightened and secured by pulling the strap of closure system 17 in the direction of the second large arrow. Top region 15*c* of front padding 15 is shown open and unsecured.

FIG. 4 shows a top region 15*c* of the front padding 15 secured over top of the closure system 17 by pulling the top region 15*c* in the direction of the third large arrow.

Figure 5:
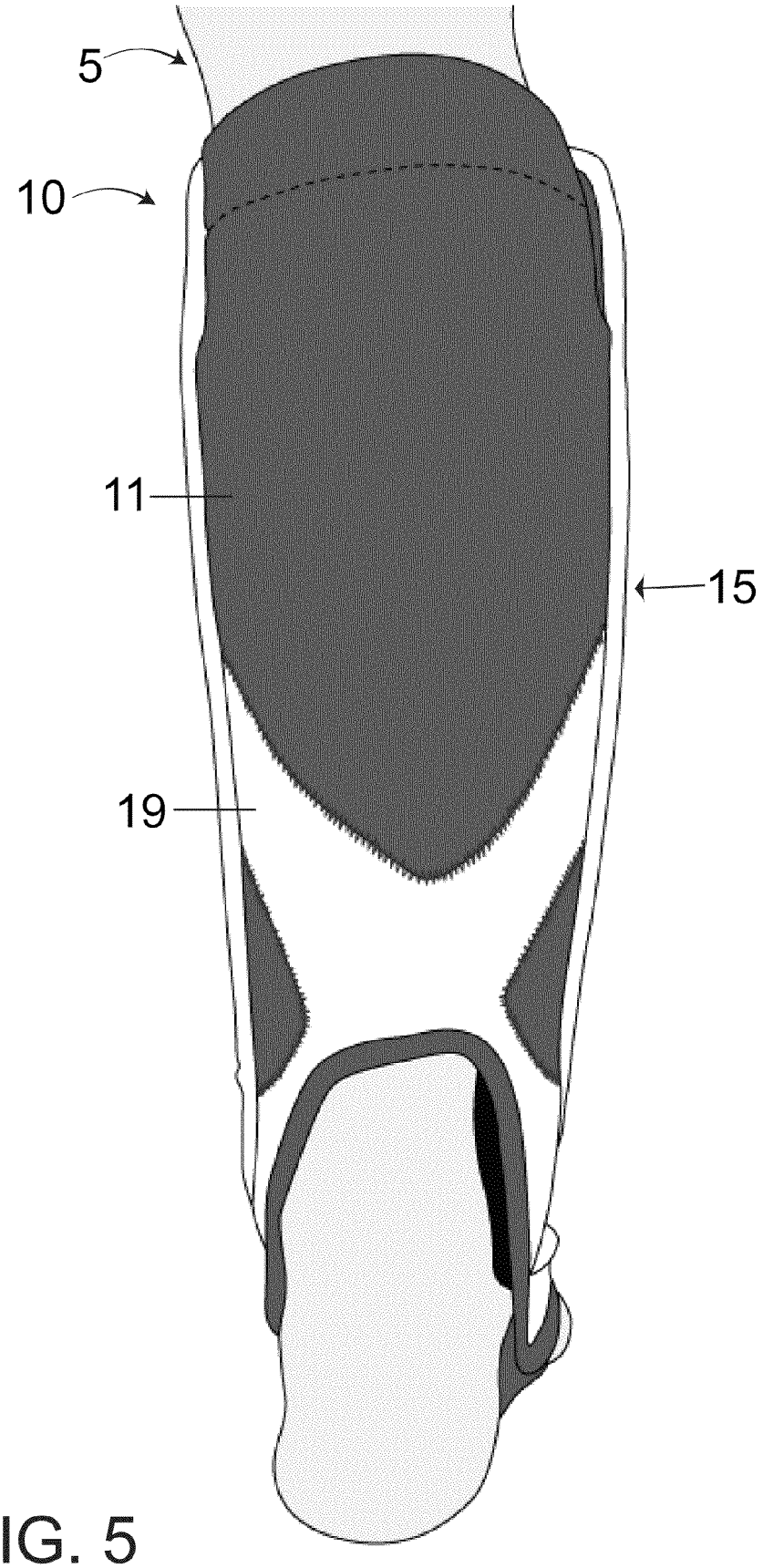
FIG. 5 shows a shin guard having an optional calf reinforcement according to a further embodiment of the present invention.
Figure 6:
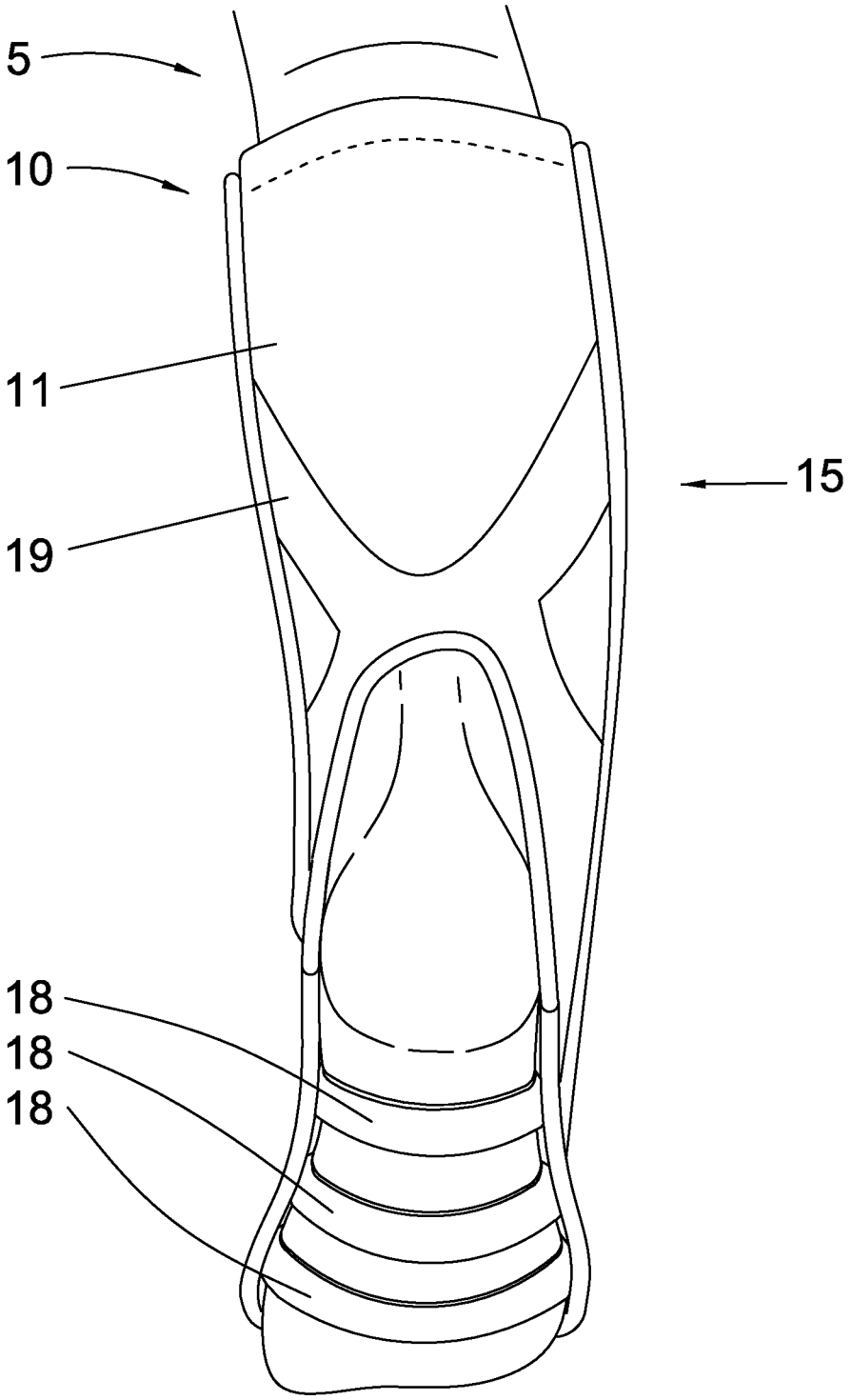
FIG. 6 shows a shin guard wherein the foot loop comprises a plurality of loops for securing the shin guard to the wearer.

As shown in FIG. 5 and according to a further optional embodiment of the present invention, the shin guard 10 also has a calf-reinforcement 19 in an optional embodiment of the present invention on the back bottom of sleeve 11 to add support to the shin guard 10, particularly for repeated flexing and extension of the wearer's foot, and specifically to support the calf of the wearer. Calf-reinforcement 19 may be of any suitable material but is preferably less elastic than the sleeve 11 material. Calf-reinforcement 19 is preferably affixed over the sleeve 11 on the outward facing surface and in another preferred embodiment is cross-, or X-shaped.

During testing, the present invention has been found to be particularly effective at providing support to the calf of the wearer.

The above-described embodiments are intended to be examples of the present invention and alterations and modifications may be effected thereto, by those of skill in the art, without departing from the scope of the invention which is defined solely by the claims appended hereto, which should be given the broadest interpretation consistent with the description as a whole.

What is claimed is:

1. A shin guard for use by an individual wearer comprising:

a sleeve for surrounding a lower leg of the wearer, the sleeve having:

a top portion for securing near a knee of the wearer;

a bottom portion for securing near an ankle of the wearer;

a front portion extending along a length of the sleeve and for contacting with a shin of the wearer and having a front top portion for positioning near the knee of the wearer and a front bottom portion for positioning near an instep of a foot of the wearer;

a back portion extending along the length of the sleeve and being in contact with a calf of the wearer and having a back top portion for positioning near the knee of the wearer and a back bottom portion for positioning near a heel of the foot of the wearer; and two opposing sides extending from the top portion to the bottom portion of the sleeve and joining the front portion with the back portion of the sleeve;

a front padding extending along the front of the sleeve and having:

an instep region covering a portion of the instep of the foot of the wearer;

a shin region covering a portion of the shin of the wearer;

a top region for positioning near the knee of the wearer; and wherein the instep region is flexibly connected to the shin region for allowing bending and straightening of the ankle;

a closure system at the top portion of the sleeve for securing the shin guard to the leg of the wearer;

a fastening system comprising complementary first and second portions, the first portion of the fastening system is attached to the front top portion of the sleeve and the second portion of the fastening system is attached to the top region of the front padding;

a foot loop at the bottom portion of the sleeve for securing the shin guard to the wearer;

wherein the front padding is affixed to the front of the sleeve from the top portion to the bottom portion, except for a top region of the front padding;

wherein the top region of the front padding is selectively and adjustably secured to the sleeve at the top portion of the sleeve by fastening system;

wherein the closure system is positioned at the top front portion of the sleeve when secured; and wherein at least a portion of the closure system and the fastening system is enclosed between the front top portion of the sleeve and the top region of the front padding when the top region of the front padding is secured to the sleeve.

2. The shin guard of claim 1, wherein the sleeve is made of an elastic material.

3. The shin guard of claim 2, wherein the elastic material is neoprene.

4. The shin guard of claim 1, wherein a calf reinforcement is affixed to the back bottom of the sleeve.

5. The shin guard as in claim 4, wherein the calf reinforcement is a cross-shaped section of fabric.

6. The shin guard of claim 5, wherein the calf reinforcement is made of a material less elastic than the sleeve material.

7. The shin guard of claim 4, wherein the calf reinforcement is made of a material less elastic than the sleeve material.

8. The shin guard of claim 1, wherein the foot loop comprises a plurality of loops for securing the shin guard to the wearer.

9. The shin guard of claim 1, wherein the front padding is removable from the sleeve.

10. The shin guard of claim 1, wherein the front padding is partially removable from the sleeve.

* * * * *